United States Patent [19]

Mimura et al.

[11] Patent Number: 4,743,800

[45] Date of Patent: May 10, 1988

[54] ARRAY OF LIGHT EMITTING ELEMENTS FOR ELECTROPHOTOGRAPHIC PRINTER

[75] Inventors: Yoshiyuki Mimura; Akitoshi Toda; Yasuo Isono, all of Hachioji, Japan

[73] Assignee: Olympus Optical Co., Ltd., Japan

[21] Appl. No.: 821,420

[22] Filed: Jan. 22, 1986

[30] Foreign Application Priority Data

Jan. 25, 1985 [JP] Japan ..... 60-010976

[51] Int. Cl.[4] ..... H01J 63/04; H01J 63/06; H01J 5/16

[52] U.S. Cl. ..... 313/497; 313/110; 313/117

[58] Field of Search ..... 313/496, 497, 117, 110

[56] References Cited

U.S. PATENT DOCUMENTS

| | | | |
|---|---|---|---|
| 3,657,587 | 4/1972 | Kegelman | 313/496 |
| 3,846,662 | 11/1974 | Hooker | 313/496 |
| 3,897,614 | 8/1975 | Armstrong | 313/496 X |
| 4,047,073 | 9/1977 | Kishino | 313/497 |
| 4,081,398 | 3/1978 | Hase et al. | 313/496 X |
| 4,098,939 | 7/1978 | Kuroda et al. | 313/496 X |
| 4,551,737 | 11/1985 | Inokuchi | 313/496 X |

OTHER PUBLICATIONS

"Materials and Techniques for Electron Tubes", by W. H. Kohl, 1966, pp. 551–553.

*Primary Examiner*—Palmer C. DeMeo
*Attorney, Agent, or Firm*—Ostrolenk, Faber, Gerb & Soffen

[57] ABSTRACT

An array of light emitting elements comprises an insulating substrate, a dot anode array including a multitude of dot anodes defined by conductors and phosphors formed on the substrate, a thermionic emission cathode disposed in opposing relationship with the dot anode array, and a grid interposed between the cathode and the dot anode array. An accelerating electric field is selectively established between the dot anodes and the cathode to excite the phosphors on the dot anodes with low speed electron beams, thus causing the phosphors to emit light. The array is primarily used in an electrophotographic printer.

12 Claims, 2 Drawing Sheets

ARRAY OF LIGHT EMITTING ELEMENTS FOR ELECTROPHOTOGRAPHIC PRINTER

FIELD OF THE INVENTION AND RELATED ART STATEMENT

The invention relates to an array of light emitting elements which emit light in accordance with an information signal and in response to excitation by a low energy electron beam, and in particular, to such an array which may be used in an exposure unit for an electrophotographic printer.

A printer which is based on electro-photography is already in practical use. In an electrophotographic printer, a photosensitive member which is uniformly charged is subjected to a light beam projected from an exposure unit in accordance with an information signal to thereby form an electrostatic latent image, which is then developed and fed through an image transfer step and a fixing step to provide a hard copy. An exposure unit which may be used in such an electrophotographic printer may comprise a laser as a source of radiation, in combination with a drive optical system such as polygon mirror in order to deflect the laser beam at high speed, thus forming an electrostatic latent image. An exposure unit incorporating a laser is used with both a high speed printer where a high output laser such as a gas laser is employed, and with a low speed printer where a relatively low output laser such as a semiconductor laser is employed. However, it will be appreciated that an exposure unit incorporating a laser requires a drive optical system such as a polygon mirror in order to deflect the laser beam. High precision is required in the manufacturing of the drive optical system, which therefore does not lend itself to mass production, resulting in an increase in the cost of manufacturing such system. In addition, such a exposure unit has another disadvantage of requiring an increased size since there is an increased length of optical path from the source to the photosensitive member.

An array of light emitting diodes or an array of liquid crystal shutters are proposed to overcome such disadvantages. Such array includes a multitude of light emitting elements or shutter elements, each of which corresponds to a picture element. Each light emitting element or shutter element is individually supplied with an information signal and individually projects light onto a photosensitive member. This dispenses with the drive optical system, and also provides the advantage that the size of the exposure unit can be reduced. However, an array of light emitting diodes involves the disadvantage that the manufacturing yield of each element is low and the brightness easily varies from element to element, presenting a difficulty that elements which provide uniform brightness cannot be mass produced. In addition, since the light output is low as compared with the output from a laser, the exposure unit which incorporates such array is inapplicable to a high speed printer. An exposure unit which incorporates an array of liquid crystal shutters has an advantage that the power demand to drive the liquid crystal shutters is reduced, but suffers from the disadvantage that the liquid crystal exhibits a slow response, limiting its use to a low speed printer. In addition, because the liquid crystal shutters are non-luminescent and require a light source such as lamps on their back, the overall power dissipation of the exposure unit increases and the size of the unit also increases.

OBJECT AND SUMMARY OF THE INVENTION

It is an object of the invention to eliminate the described disadvantages by providing an array of light emitting elements for an electrophotographic printer which is small in size, can be manufactured inexpensively and lends itself to mass production and is capable of emitting a sufficient amount of light to enable a high speed response.

The invention provides the following advantages:

(1) A drive optical system which is normally required to achieve a deflection of the light beam can be dispensed with, allowing an exposure unit including an array of light emitting elements to be provided which is small in size and is durable.

(2) Various techniques may be used to form a dot anode array and phosphor in a facilitated manner and to a high precision, thus lending itself to mass production.

(3) A high luminous intensity of the light source can be secured in comparison to an array of light emitting elements. Also, a higher response can be achieved in comparison to an array of liquid crystal shutters, thus enabling its application to a high speed printer.

(4) The brightness of the light source can be easily controlled by changing a grid voltage and an anode voltage, facilitating the reproduction of halftones.

DETAILED DESCRIPTION OF PREFERRED EMBODIMENT

Figure 1:
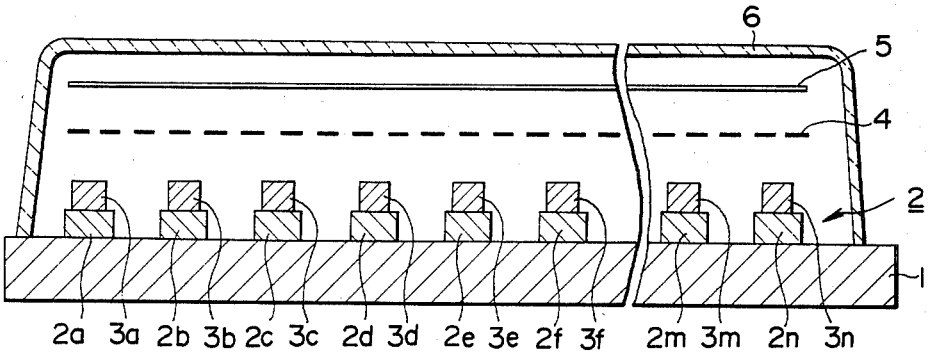
FIG. 1 is an enlarged cross section of an array of light emitting elements according to one embodiment of the invention.

Referring to FIG. 1, there is shown an array of light emitting elements according to one embodiment of the invention in cross section. A substrate 1 formed of an insulating material such as glass or alumina has a dot anode array 2 formed thereon. The dot anode array 2 comprises a linear array of either square or rectangular dot anodes 2*a* to 2*n* which measure 50 to 100 μm on a side. The dot anode array 2 has a length which is sufficient to cover the width of a photosensitive member on which an electrostatic latent image is to be formed, for example an exposure unit of a printer. By way of example, where a latent image is formed with a width of A-4 size (210 mm) according to JIS standards, the length of the array 2 should be equal to or greater than 210 mm. A number of dot anodes are provided so as to assume a given resolution, for example, 20 dots per millimeter. The dot anodes 2*a* to 2*n* are spaced apart by a distance of from 50 to 100 μm to prevent an electrical and an optical interruption therebetween. The individual anodes 2*a* to 2*n* are connected with associated anode wires (one such wire 14 being shown in FIG. 2), each sure wire supplying a respective print signal individually to individual ones of said anodes from an appropriate control circuit 15. Phosphors 3*a* to 3*n* are formed on the upper surface of the individual dot anodes 2*a* to 2*n* as by thick film printing, electron beam evaporation, or evaporation, sputtering or chemical vapor deposition (CVD)

techniques. The phosphors 3a to 3n are characterized to emit light due to excitation which occurs in response to irradiation with a low energy electron beam. A material which has an excellent response, a reduced afterglow and a spectral sensitivity which is compatible with a photosensitive member is selected. For example, where a Se-Te photosensitive member is used, it has a spectral sensitivity in a wavelength region from 400 to 500 μm, and accordingly, a low speed electron beam phosphor ZnO:Zn is preferred for use with this photosensitive member. Alternatively, where a photosensitive member comprising a-Si:H or a-phthalocyanine is used, a phosphor having a luminous peak in a red region such as (Zn, Cd)S:Ag is preferred. Considering the afterglow response, a print-out of 20 sheets per minute of A-4 size according to JIS standards, for example, corresponds to an output rate of a sheet in three seconds since the sheet has a length of 295 mm. Assuming a resolution of 10 dots/mm, the light emitting element may have a luminescence time of about 1 msec/line. Accordingly, an afterglow time (the time interval required for the luminescence to reduce to or below 10% of its peak value) is preferably equal to or less than 1 msec. Specifically, phosphors such as ZnS:Mn, $Zn_2SiO_4$:Mn, $ZnF_2$:Mn, $MgF_2$:Mn, ZnS:Ag, ZnS:Cu, ZnS:Pb or the like are unsuitable because they are incapable of producing discrete luminescence for the lines inasmuch as the 10% afterglow time is long, on the order of 25 to 1,000 msec. Suitable materials having shorter afterglow time include $Y_3Al_5O_{12}$:Ce $+In_2O_3$ (having 10% afterglow time of 0.16 μsec), $Y_2SiO_5$: Ce$+In_2O_3$ (0.08 μsec), ZnO:Zn (2.8 μsec), (Zn, Cd)S:Ag$+In_2O_3$ (0.05 to 2 msec) ZnS:Au(1 msec or less), ZnS:Al$+In_2O_3$ (1 msec or less), ZnS:Ag (1 msec or less), ZnS:$In_2O_3$ (1 msec or less) and ZnS:Ag$+In_2O_3$ (1 msec or less).

A grid 4 is disposed in opposing relationship with the dot anode array. The grid 4 comprises a meshwork of stainless steel disposed in parallel relationship with the array 2. A cathode 5 is disposed on the opposite side of the grid 4 from the anode array 2. The cathode 5 comprises tungsten wires of 7 to 20 μm coated with ternary alkaline earth metal carbonate (Ba, Sr, Ca)—$Co_3$, which wires are spanned so as to extend parallel to the anode array 2. A faceplate 6 formed of a transparent material is disposed in surrounding relationship with the dot anode array 2, grid 4 and cathode 5, and is fused to the substrate 1 by frit glass which provides a vacuum seal. The enclosure is vacuum sealed after vaporizing getter and evacuation. It will be appreciated that the opposite ends of the anode wires, grid 4 and cathode 5 are taken externally and connected to a drive circuit, a grid power supply and a cathode power supply, respectively.

In operation, assuming a static drive, the grid 4 is used in common for all of the dot anodes 2a to 2n, d.c. biasing voltages in a range from 5 to 20 V are selectively applied to the dot anodes 2a to 2n for luminescence. The cathode 5 is initially connected to a cathode power supply, and either a d.c., an a.c. or a pulse voltage is applied to the cathode 5, which then produces a thermionic emission upon heating. The emission of thermions is maintained during the operation of the array of light emitting elements. A grid power supply applies a positive d.c. biasing voltage, for example, 10 V, to the grid 4 while a positive d.c. voltage which is higher than the grid voltage, for example, an anode voltage of 15 V, is selectively applied to the individual dot anodes 2a to 2n. When any one of the dot anodes 2a to 2n is supplied with the anode voltage, the thermions emitted by the cathode 5 are accelerated by an electric field which is selectively formed between the grid 4 and that dot anode, thus producing a low speed electron beam of from several to several tens of eV (electron volts). Such electron beam impinges upon the phosphor on the dot anode to excite it, which then emits light. Radiation from the phosphor is radiated in a direction away from the substrate 1 through the faceplate 6. On the other hand, when no anode voltage is applied to the dot anodes 2a to 2n, an accelerating field is not formed between the grid 4 and the dot anodes, and hence thermions of a low energy level only reach the phosphors 3a to 3n. Such thermions are insufficient to excite the phosphors 3a to 3n above their luminescence threshold, whereby the phosphors do not emit light. The magnitude of the grid voltage and the anode voltage is chosen in consideration of the printing speed of the printer so as to provide a sufficient amount of light. A suitable choice of the grid voltage and the anode voltage enables the reproduction of halftones in a facilitated manner.

Figure 2:
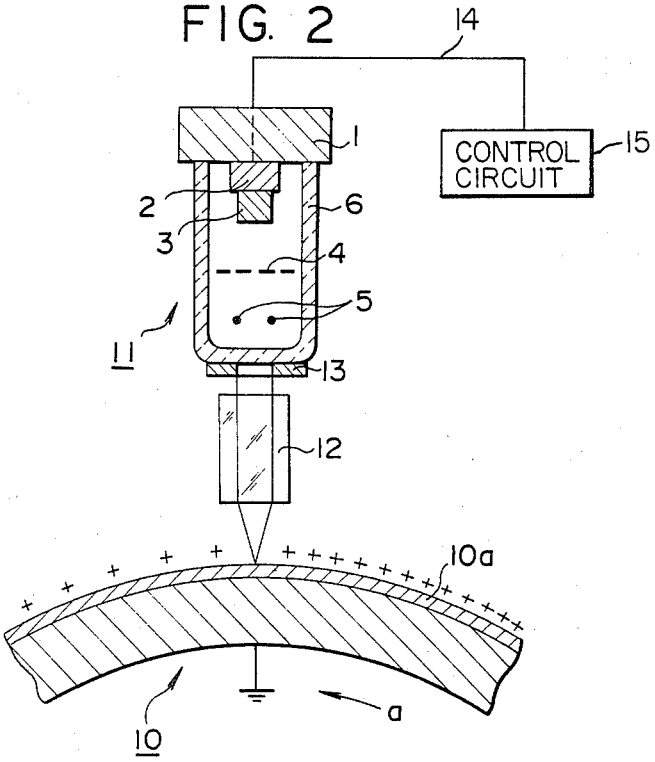
FIG. 2 is an enlarged cross section of an array of light emitting elements which is incorporated into an exposure unit of a printer.

FIG. 2 is an enlarged cross section of an array of light emitting elements as applied to an exposure unit of a printer. In this embodiment, a photosensitive drum 10 carrries a photoconductive layer 10a on which an electrostatic latent image is to be formed. A rod lens 12 is disposed between the array 11 and the drum 10 for causing convergence of light flux radiated by the array 11 so as to be focussed onto the drum 10. To prevent an interaction between light fluxes radiated from the individual phosphors 3a to 3n, a slit mask 13 is mounted on the surface of the faceplate 6 which is located opposite to the dot anode array 2, the mask having openings at a pitch which is equal to the pitch of dots on the array 2. The information signal to be copied is converted into a printer signal and is fed through an associated drive circuit to the individual dot anodes 2a to 2n. The photosensitive drum 10 is initially charged uniformly, and rotates in a direction indicated by an arrow a. A print signal in the form of a positive d.c. voltage is selectively applied to the individual dot anodes 2a to 2n in synchronism with the rotation of the drum 10, thereby selectively exciting the phosphors 3a to 3n for luminescence. The light radiated passes through the transparent faceplate 6, the slit mask 13 and the rod lens 12 to be focussed upon the drum 10. As a consequence, the charge on the drum 10 is selectively neutralized to define an electrostatic latent image.

Figure 3:
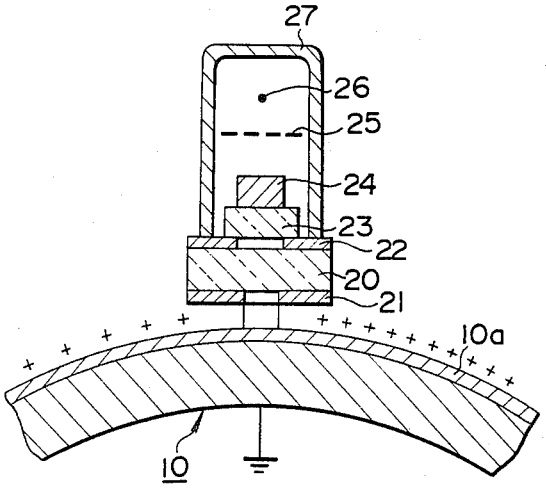
FIG. 3 is an enlarged cross section of a modification of the array of the invention.

FIG. 3 is an enlarged cross section of a modification of the array of light emitting elements according to the invention. In this arrangement, a pair of slit masks 21 and 22 are formed on the opposite sides of a transparent substrate 20, and a dot anode array 23 comprising transparent electrodes such as indium tin oxide (ITO) or hexagonal meshes is formed so as to correspond to openings in the masks 21, 22. Phosphors 24 are formed on the individual dot anodes. A combination of a grid 25 and a cathode 26 is disposed in opposing relationship with the phosphors 24, with the assembly vacuum sealed within a faceplate 27. When an anode voltage is selectively applied to the dot anode array 23, the individual phosphors 24 are selectively excited for luminescence, whereby light emitted by the phosphors 24 passes through the dot anode array 23 located on their back, the slit mask 22, the transparent substrate 20 and the slit mask 21 to impinge upon the photosensitive member 10. With this arrangement, it is unnecessary to dispose a lens system between the array of light emitting elements and the photosensitive member, allowing the array to be disposed in close proximity to the photosensitive member and allowing the exposure unit to be reduced in size.

EXAMPLE

Dot anodes, which are squares measuring 50 μm on a side, are disposed in a linear array on a glass substrate with a spacing of 50 μm, thus forming a dot anode array. A phosphor comprising ZnO:Zn with a mixing binder is applied by a thick film printing technique on each dot anode. A meshwork grid of stainless steel is disposed above the array, and a cathode is disposed at a spacing of 500 μm from the grid. After applying a getter, a faceplate is fused by frit seal, and a slit mask is formed on the surface of the faceplate which is disposed opposite to the anode array. The resulting array of light emitting elements is disposed over the photosensitive drum as indicated in FIG. 2, with a converging rod lens disposed between the drum and the array to define an exposure unit. The photosensitive drum comprises a Se-Te system and is charged to +500 V. A grid voltage of 10 V and an anode voltage of 15 V are applied to the array, and utilizing a static drive technique, an information signal is read from a frame memory line by line to perform an exposure operation, thus forming an electrostatic latent image. When the resulting latent image is developed with a magnetic brush and then subjected to a transfer and a fixing step to provide a copy, it is found that the copy obtained exhibits an excellent resolution and is free from any fogging in its non-image area.

It should be understood that the invention is not limited to the embodiment, modification or example mentioned above, but that a number of changes, modifications and substitutions will readily occur to one skilled in the art from the above disclosure. For example, while the embodiment described above employs a static drive technique in which the cathode and grid are used in common while an anode voltage is individually applied to dot anodes, a dynamic drive technique may also be used in which a grid is individually associated with a dot anode so that an accelerating voltage may be selectively applied between a dot anode and its associated grid to cause an individual luminescence of each phosphor.

Alternatively, the dot anode array may comprise a high density array of MOS-FET having a phosphor disposed on a drain electrode. With this array, it is possible to achieve an increased density of picture elements and a reduction in the drive voltage.

In the embodiment described above, the grid comprises a meshwork, but it may comprise a plurality of wires in parallel relationship with the anode array.

What is claimed is:

1. An array of light emitting elements for an electrophotographic printer comprising:

a dot anode array including a transparent insulating substrate on which a multitude of dot anodes are disposed in an array, each dot anode is formed of a transparent material and having phosphor located thereon;

a thermionic emission cathode disposed in opposing relationship with the dot anode array for irradiating the phosphors on the dot anodes with low speed electron beams;

a grid disposed between the cathode and the dot anode array for selectively developing an accelerating electric field between the grid and the dot anodes when an appropriate biasing voltage is applied to said grid;

a faceplate disposed in surrounding relationship with the dot anode array, the thermionic emission cathode and the grid, the faceplate being vacuum sealed to the insulating substrate; and the transparent insulating substrate having opposite sides to each of which is applied a respective slit mask having openings formed therein which are disposed at a pitch equal to the pitch of dots in the dot anode array so that radiation emitted by the phosphor may be projected through the dot anode and through the slit masks of the transparent insulating substrate.

2. An array according to claim 1 in which the thermionic emission cathode comprises a tungsten wire coated with ternary carbonate of alkaline-earth metals ((Ba, Sr, Ca) —$CO_3$).

3. An array according to claim 1 in which the grid is formed by a meshwork of stainless steel.

4. An array according to claim 1 in which each phosphor has a 10% afterglow time which is equal to or less than 1 msec.

5. An array according to claim 4 in which the phosphor having a 10% afterglow time equal to or less than 1 msec is chosen from a group consisting of $Y_3Al_5O_{12}$:Ce+$In_2O_3$, $Y_2SiO_5$:Ce+$In_2O_3$, ZnO:Zn, (Zn, Cd)S:Ag+$In_2O_3$, ZnS:Au, ZnS:Al+$In_2O_3$, ZnS:Ag, ZnS:$In_2O_3$ and ZnS:Ag+$In_2O_3$.

6. An array according to claim 1 wherein said multitude of dot anodes are disposed in a linear array on the substrate.

7. An array according to claim 1 wherein the multitude of dot anodes are disposed at an equal spacing on the substrate.

8. An array according to claim 1 wherein the multitude of dot anodes are formed of an electrically conductive material.

9. An array according to claim 8 wherein said electrically conductive material of the dot anodes is selected from the group of aluminum, gold, silver, or copper.

10. An array according to claim 1 wherein each dot anode has a square configuration.

11. An array according to claim 1 wherein each dot anode is connected to an anode wire which supplies a luminescence signal.

12. An array according to claim 1, further including means for applying print signals to selected ones of the dot anodes, the print signals being at a voltage level which will cause the phosphor on only the selected dot anodes to be irradiated.

* * * * *